US008229311B2

(12) United States Patent
Yanagihara

(10) Patent No.: US 8,229,311 B2
(45) Date of Patent: Jul. 24, 2012

(54) IMAGE FORMING DEVICE FOR DETERMINING TRANSFER CURRENT BASED ON AMBIENT CONDITIONS

(75) Inventor: Yusuke Yanagihara, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 156 days.

(21) Appl. No.: 12/821,491

(22) Filed: Jun. 23, 2010

(65) Prior Publication Data

US 2011/0008065 A1 Jan. 13, 2011

(30) Foreign Application Priority Data

Jul. 7, 2009 (JP) ..... 2009-160471

(51) Int. Cl.
*G03G 15/16* (2006.01)
*G03G 15/00* (2006.01)

(52) U.S. Cl. ..... 399/66; 399/44

(58) Field of Classification Search ..... 399/66, 399/44

See application file for complete search history.

(56) References Cited

U.S. PATENT DOCUMENTS 5,034,777 A * 7/1991 Ohzeki et al. ..... 399/66
5,717,980 A * 2/1998 Oka et al. ..... 399/66
6,111,594 A * 8/2000 Jeong ..... 399/66 X
7,778,558 B2 * 8/2010 Uchida et al. ..... 399/66 X
2005/0100357 A1 5/2005 Nishimura et al.
2006/0029410 A1 2/2006 Deguchi

FOREIGN PATENT DOCUMENTS

JP 06-161295 6/1994
JP 2002-139910 A * 5/2002
JP 2004-334017 11/2004
JP 2005-189466 7/2005
JP 2006-053175 2/2006

* cited by examiner

*Primary Examiner* — Sophia S Chen

(74) *Attorney, Agent, or Firm* — Banner & Witcoff, Ltd.

(57) ABSTRACT

An image-forming device includes an image-bearing member, transfer unit, bias applying unit, a pair of conveying rollers, first sensor, second sensor, determining unit, and controller. An image is formed with developer on the image-bearing member. The transfer unit transfers the image formed on the image bearing member onto a sheet of paper at a transfer position located between the image-bearing member and the transfer unit. The bias applying unit applies a transfer bias to the transfer unit. The conveying rollers convey the sheet of paper to the transfer position. The first sensor detects an electrical property of the conveying rollers. The second sensor detects an electrical property of the transfer unit. The determining unit determines a bias for an ambient condition based on the detection results of the first sensor and the second sensor. The controller controls the bias applying unit to apply the bias to the bias applying unit.

15 Claims, 9 Drawing Sheets

FIG.6

| VOLTAGE DIFFERENCE ⊿V(kV) | HUMIDITY |
|---|---|
| ~0.05 | (HIGH) |
| 0.05~ | (LOW) |

FIG.7

| RESISTANCE R(MΩ) | CATEGORY |
|---|---|
| ~100 | a (H/H , H/L) |
| 100-200 | b (H/L , L/H , N/L) |
| 200-300 | c |
| 300~ | d (L/L) |

FIG.8

| TRANSFER CURRENT (-μA) | CATEGORY | | | |
|---|---|---|---|---|
| | a(~100MΩ) | b(100-200MΩ) | c(200-300MΩ) | d(300MΩ~) |
| (HIGH) | 8(H/H) | 10(H/L) | 10 | 10 |
| (LOW) | 20(H/L) | 20(N/L , H/L) | 14 | 10(L/L) |

| RESISTANCE VALUE (log Ω) | | HUMIDITY [ % ] | | | |
|---|---|---|---|---|---|
| | | 20.0 | 40.0 | 60.0 | 80.0 |
| TEMPERATURE [ °C ] | 10.0 | 8.4～8.6 | 8.2～8.4 | 8.0～8.2 | 7.8～8.0 |
| | 17.5 | 8.2～8.4 | 7.8～8.0 | 7.8～8.0 | 7.4～7.6 |
| | 25.0 | 7.8～8.0 | 7.8～8.0 | 7.6～7.8 | 7.2～7.4 |
| | 32.5 | 7.8～8.0 | 7.6～7.8 | 7.4～7.6 | 8.4～8.6 |

IMAGE FORMING DEVICE FOR DETERMINING TRANSFER CURRENT BASED ON AMBIENT CONDITIONS

CROSS REFERENCE TO RELATED APPLICATION

This application claims priority from Japanese Patent Application No. 2009-160471 filed Jul. 7, 2009. The entire content of this application is incorporated herein by reference.

TECHNICAL FIELD

The present invention relates to an image-forming device.

BACKGROUND

An electrophotographic type image-forming device applies a transfer bias to a transfer unit to transfer an image formed on an image-bearing member onto a paper nipped between the image-bearing member and the transfer unit. In order to form a clear image with such an image-forming device, it is important to apply an appropriate transfer bias to the transfer unit. If the transfer bias is less than the appropriate transfer bias, the force of attraction or adherence of toner to paper is insufficient. This may result in scattered toner and ghost images produced by residual toner on the image-bearing member. Conversely, if the transfer bias is excessive, an electric discharge can occur between the image-bearing member and the paper. The electric discharge can damage the image-bearing member or produce a discharge pattern in the transferred image.

An appropriate transfer bias is determined based on the electrical resistance of the transfer system including the transfer unit, the image-bearing member, and the paper. On the other hand, these resistances change in accordance with variations in ambient conditions, and particularly in temperature and humidity. Therefore, the appropriate transfer bias also changes in accordance with variations in ambient conditions. The invention disclosed in Japanese unexamined patent application publication No. 2006-53175 detects the resistance of the transfer system, determines an optimal transfer current for the detected resistance by referring to a predetermined characteristic curve indicating an optimal transfer current for each resistance, and matches the transfer current flowing in the transfer roller to the determined optimal transfer current.

SUMMARY

The above invention determines an optimal transfer current for the ambient conditions based on the resistance of the transfer system. However, the resistance detected under certain ambient conditions can be the same as the resistance detected under other ambient conditions. For example, although the optimal transfer current for a high temperature/low humidity environment (H/L environment) is greatly different from the optimal transfer current for a low temperature/high humidity environment (L/H environment), the resistance detected in the H/L environment can be the same as the resistance detected in the L/H environment. In such a case, the above invention cannot correctly determine whether the ambient conditions correspond to an H/L environment or an L/H environment. As a result, the optimal transfer current for an H/L environment might be mistakenly applied under an L/H environment.

As described above, it is difficult to determine an optimal transfer current for the ambient conditions based solely on the resistance in the transfer system.

In view of the foregoing, it is an object of the present invention to provide an image-forming device capable of applying a transfer bias to a transfer unit that is optimal for the ambient conditions.

In order to attain the above and other objects, the invention provides an image-forming device including an image-bearing member, a transfer unit, a bias applying unit, a pair of conveying rollers, a first sensor, a second sensor, a determining unit, and a controller. A developer image is formed with developer on the image-bearing member. The transfer unit transfers the developer image formed on the image bearing member onto a sheet of paper at a transfer position located between the image-bearing member and the transfer unit. The bias applying unit applies a transfer bias to the transfer unit. The pair of conveying rollers conveys the sheet of paper to the transfer position. The first sensor detects an electrical property of the pair of conveying roller. The second sensor detects an electrical property of the transfer unit. The determining unit determines an optimal bias for an ambient condition based on both of the detection results of the first sensor and the second sensor. The controller controls the bias applying unit to apply the optimal bias to the bias applying unit.

Another aspect of the invention provides an image-forming device including an image-bearing member, a supply roller, a transfer unit, a bias applying unit, a first sensor, a second sensor, a determining unit, and a controller. A developer image is formed with developer on the image-bearing member. The supply roller supplies the developer to the image-bearing member. The transfer unit transfers the developer image formed on the image bearing member onto a sheet of paper at a transfer position located between the image-bearing member and the transfer unit. The bias applying unit applies a transfer bias to the transfer unit. The first sensor detects an electrical property of the supply roller. The second sensor detects an electrical property of the transfer unit. The determining unit determines an optimal bias for an ambient condition based on both of the detection results of the first sensor and the second sensor. The controller controls the bias applying unit to apply the optimal bias to the bias applying unit.

BRIEF DESCRIPTION OF THE DRAWINGS

The particular features and advantages of the invention as well as other objects will become apparent from the following description taken in connection with the accompanying drawings, in which:

FIG. 6 is a first data table for determining a humidity condition;

FIG. 7 is a second data table for determining an ambience category;

FIG. 8 is a third data table for determining a transfer bias;

DETAILED DESCRIPTION

First Embodiment

[Configuration of Image-Forming Device]

A laser printer 1 (an image-forming device) according to a first embodiment of the present invention will be described while referring to the accompanying drawings.

The terms "upward", "downward", "upper", "lower", "above", "below", "beneath", "right", "left", "front", "rear" and the like will be used throughout the following description under the assumption that the laser printer 1 is disposed in an orientation in which it is intended to be used.

Figure 1:
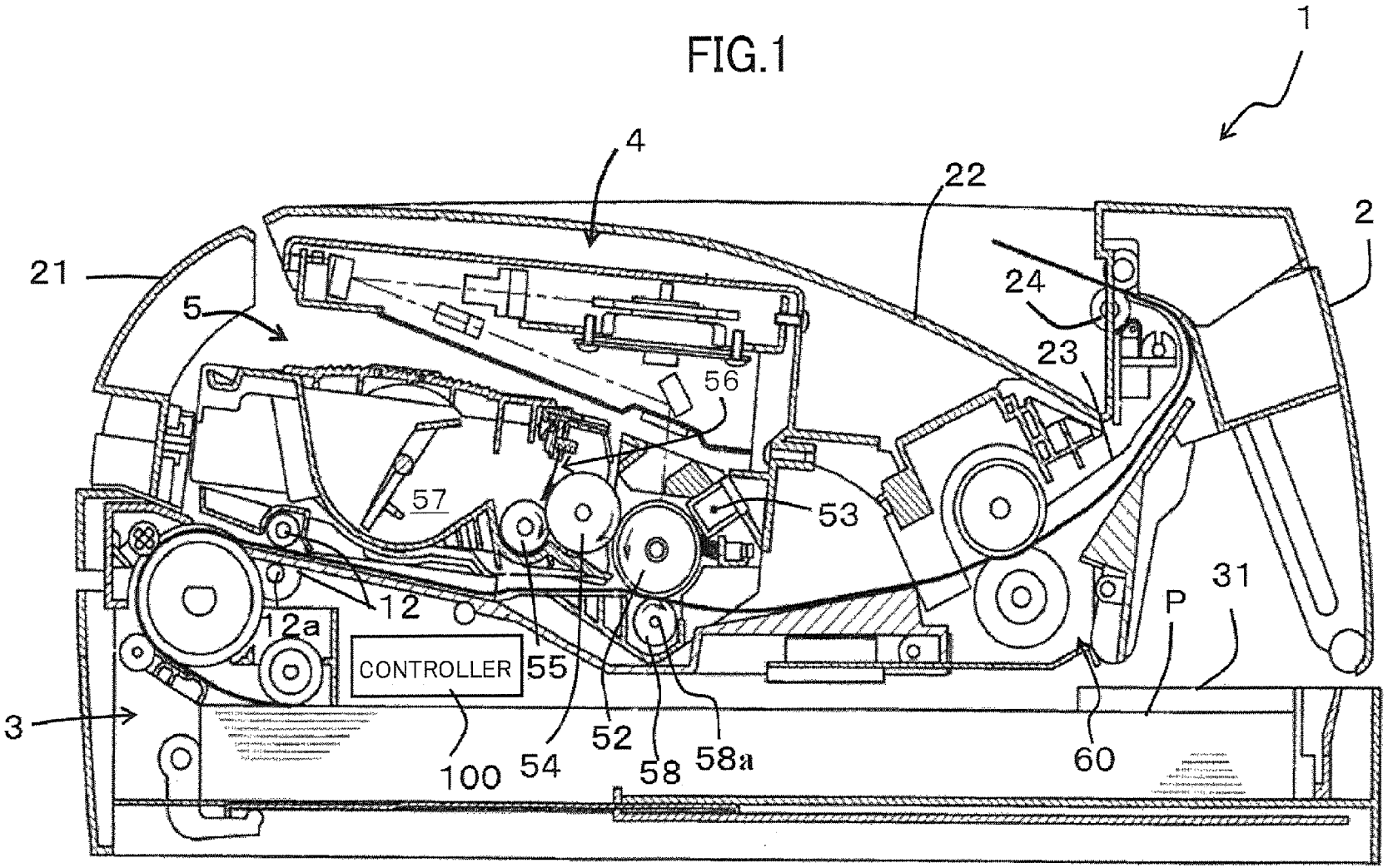
FIG. 1 is a cross-sectional view of main sections in a laser printer.

As shown in FIG. 1, the laser printer 1 is configured of a main casing 2 that mainly accommodates a feeder unit 3 for supplying a paper P, a scanning unit 4, a process cartridge 5 for forming a toner image and transferring the toner image onto the paper P, a fixing unit 60 for heat-fixing the transferred toner image to the paper P, and a controller 100. A front cover 21 is provided so as to be able to open and close over an opening formed at the front side of the main casing 2. The process cartridge 5 is mounted in or removed from the main casing 2 through the opening when the front cover 21 is opened. A discharge tray 22 for receiving and maintaining a paper P discharged from the main casing 2 is formed on the top surface of the main casing 2.

The controller 100 for controlling operations performed on each unit in the laser printer 1 (for example, operations described later to form an image and to determine a transfer bias) is disposed at a predetermined position in the main casing 2.

The feeder unit 3 is mounted in a lower section of the main casing 2. The feeder unit 3 includes a feeding tray 31 detachably mounted in the main casing 2, various rollers for conveying the paper P accommodated in the feeding tray 31, and a pair of registration rollers 12.

At the beginning of an image-forming operation, one sheet of the paper P accommodated in the feeding tray 31 is conveyed to the pair of registration rollers 12 by the various rollers.

The pair of registration roller 12 conveys the paper P to an image-forming position after correcting misalignment in the paper P. The image-forming position in the preferred embodiment is a position at which a photosensitive drum 52 is in confrontation with a transfer roller 58 and at which a toner image formed on the photosensitive drum 52 is transferred onto the paper P.

The process cartridge 5 is detachably mounted in a section of the main casing 2 below the scanning unit 4. The process cartridge 5 mainly includes the photosensitive drum 52 having an organic photosensitive layer, a charger 53, a developing roller 54, a supply roller 55, a thickness-regulating blade 56, a toner accommodating unit 57, and the transfer roller 58. The toner accommodating unit 57 accommodates positive-charging nonmagnetic, single-component toners.

The transfer roller 58 is disposed on a downstream side of the pair of registration rollers 12 in a conveying direction of the sheet P. The transfer roller 58 is in confrontation with the photosensitive drum 52 from the underside of the photosensitive drum 52 and is supported by the process cartridge 5 so as to be capable of rotating in a direction indicated by the arrow (clockwise).

The charger 53 charges the surface of the photosensitive drum 52 uniformly. The scanner unit 4 irradiates a laser beam in a high-speed scan on the charged surface of the photosensitive drum 52. As a result, the electric potential of the portion of the surface exposed to the laser beam drops, and an electrostatic latent image based on image data is formed on the surface of the photosensitive drum 52.

The electrostatic latent image is developed into a visible image with toner that is carried on the surface of the developing roller 54 from the toner accommodating unit 57 via the supply roller 55 and that has been smoothed by the thickness-regulating blade 56 into a thin layer of uniform thickness. Thus, a toner image is formed on the photosensitive drum 52.

The toner image formed on the photosensitive drum 52 is transferred onto the paper P when the paper P passes between the photosensitive drum 52 and the transfer roller 58.

The paper P is conveyed to the fixing unit 60, and the toner image transferred onto the paper P is fixed to the paper P by heat generated in the fixing unit 60. The paper P is conveyed to a discharge roller 24 along a discharge path 23, and is discharged from the main casing 2 onto the discharge tray 22 by the discharge roller 24.

[Electrical Configuration of Laser Printer]

Next, the electrical configuration of the laser printer 1 will be described.

Figure 2:
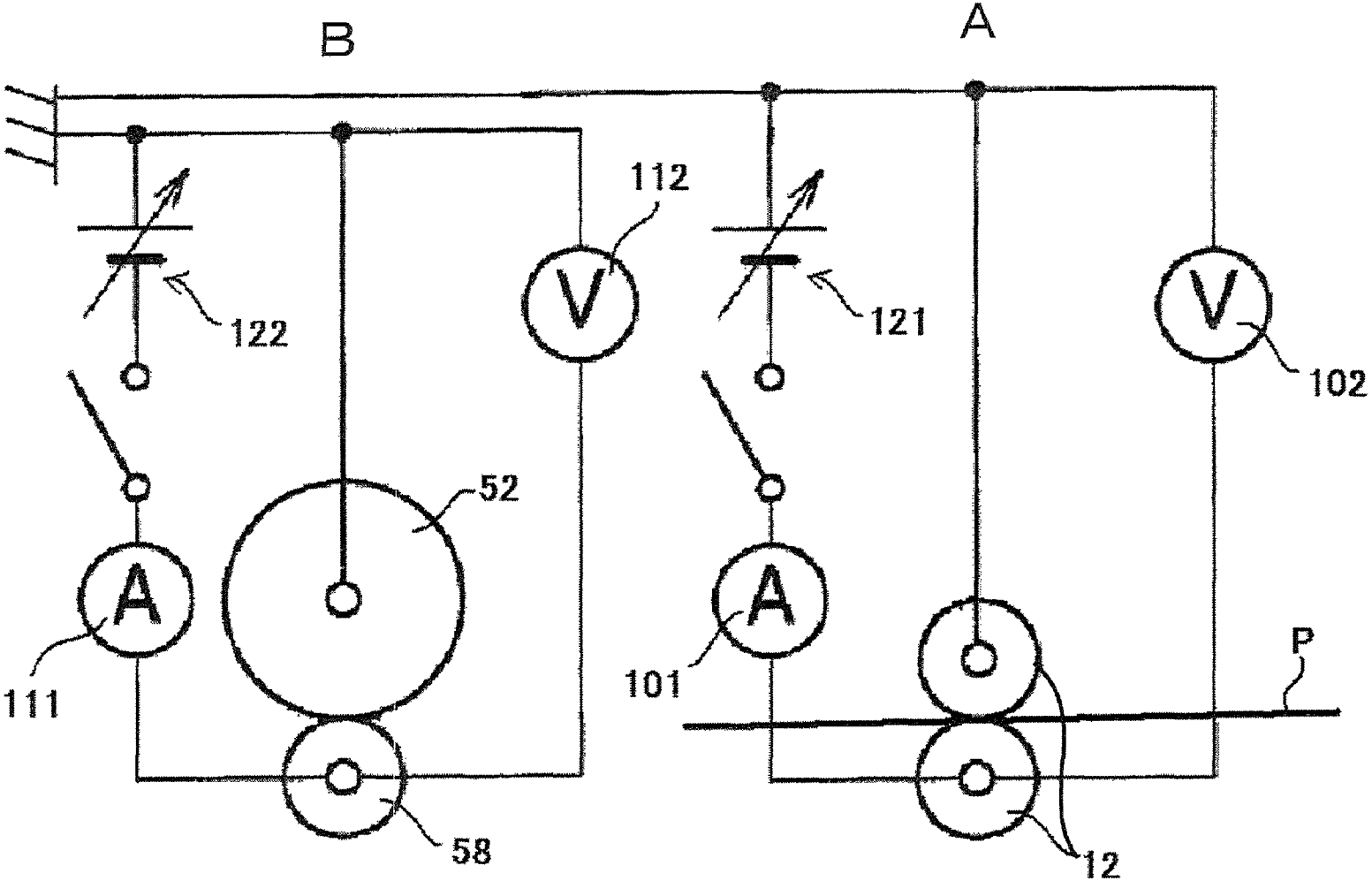
FIG. 2 is a circuit diagram for applying a bias to a transfer roller and a registration roller according to a first embodiment.
Figure 3:
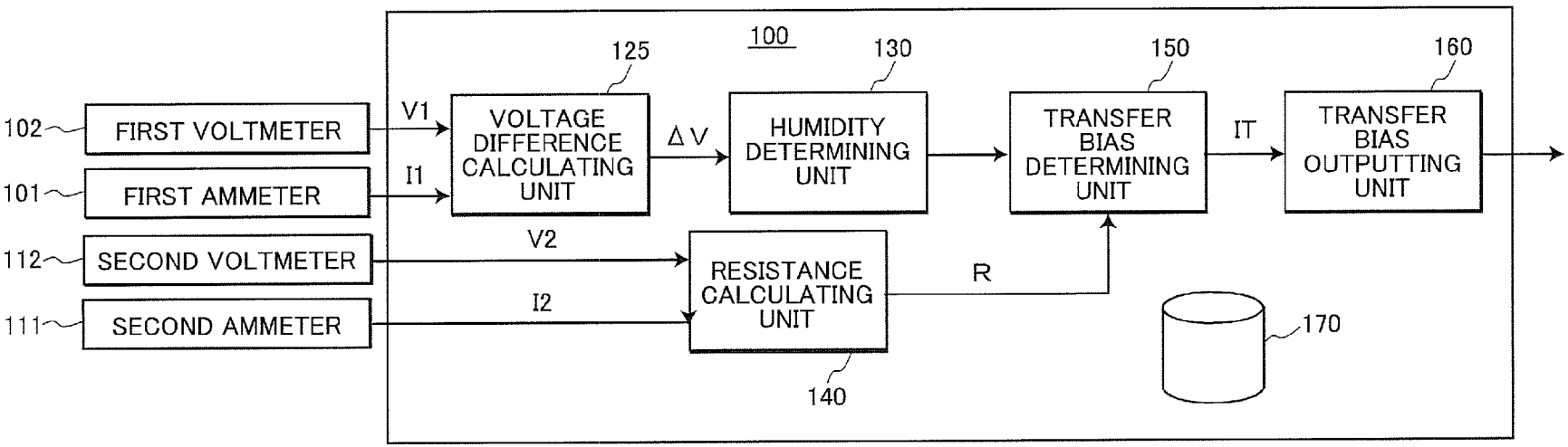
FIG. 3 is a block diagram of a controller.

As shown in FIG. 2, in a circuit A, a power source 121, the pair of registration rollers 12, and a first ammeter 101 are connected in series, and a first voltmeter 102 is connected in parallel with the pair of registration rollers 12. In the circuit A, the positive terminal of the power circuit 121 is connected to the upper registration roller 12 in FIG. 2 while the negative terminal of the power source 121 is connected to the lower registration roller 12. The power source 121 employs variable resistance to output a bias corresponding to an input signal from the controller 100. The first ammeter 101 detects a current value I1 of a current flowing in the circuit A, and the first voltmeter 102 detects a voltage value V1 of a voltage applied between the pair of registration rollers 12. As shown in FIG. 3, the first ammeter 101 and the first voltmeter 102 output the respectively detected current value I1 and voltage value V1 to a voltage difference calculating unit 125.

As shown in FIG. 2, in a circuit B, a power source 122, the photosensitive drum 52, the transfer roller 58, and a second ammeter 111 are connected in series, and a second voltmeter 112 is connected in parallel with the photosensitive drum 52 and the transfer roller 58. In the circuit B, the positive terminal of the power source 122 is connected to the photosensitive drum 52 while the negative terminal of the power source 122 is connected to the transfer roller 58. The power source 122 employs variable resistance to output a bias corresponding to an input signal from the controller 100. The second ammeter 111 detects a current value I2 of a current flowing in the circuit B, and the second voltmeter 112 detects a voltage value V2 of a voltage applied between the photosensitive drum 52 and the transfer roller 58. As shown in FIG. 3, the second ammeter 111 and the second voltmeter 112 output the respectively detected current value I2 and voltage value V2 to a resistance calculating unit 140.

The controller 100 includes a CPU, a ROM, a RAM, etc. (not shown). As shown in FIG. 3, the controller 100 includes the voltage difference calculating unit 125, a humidity determining unit 130, the resistance calculating unit 140, a transfer bias determining unit 150, a transfer bias outputting unit 160, and a storing unit 170. The humidity determining unit 130, the resistance calculating unit 140, the transfer bias determining unit 150, and the transfer bias outputting unit 160 correspond to the above CPU.

The storing unit 170 corresponds to the above ROM and RAM. The storing unit 170 stores various programs that are used by the CPU for controlling each section of the laser printer 1. The CPU reads and executes the various programs stored in the storing unit 170 to control the operations of the laser printer 1. The storing unit 170 also stores various data tables, such as a first data table for determining a humidity condition (FIG. 6), a second data table for determining an ambience category (FIG. 7), and a third data table for determining a transfer bias (FIG. 8) described later.

Ambient conditions in the preferred embodiment include a humidity condition indicating whether the relative humidity in the environment of the laser printer 1 is high or low, and a temperature condition indicating whether the temperature in the environment of the laser printer 1 is high or low. The relative humidity is a percentage (%) found by multiplying the ratio of actual moisture (moisture partial pressure) to saturated moisture (saturated moisture partial pressure) at normal atmosphere and a predetermined temperature by one hundred. In the preferred embodiment, "low humidity" denotes a humidity below 50%, while "high humidity" denotes a humidity above 50%.

The voltage difference calculating unit 125 calculates a voltage difference $\Delta V$ between the voltage value V1 detected by the first voltmeter 102 when the paper P is sandwiched between the pair of registration rollers 12 and the voltage value V1 detected by the first volt meter 102 when the paper P is not sandwiched between the pair of registration rollers 12, and outputs the calculated voltage difference $\Delta V$ to the humidity determining unit 130.

The humidity determining unit 130 determines whether the humidity condition around the laser printer 1 is high or low based on the voltage difference $\Delta V$ outputted from the voltage difference calculating unit 125 by referencing the first data table (FIG. 6) stored in the storing unit 170. When receiving the printing command, the humidity determining unit 130 determines the humidity condition and stores the determined humidity condition in the storing unit 170. The humidity determining unit 130 also outputs the humidity condition to the transfer bias determining unit 150.

The resistance calculating unit 140 calculates a resistance R of the transfer system (the photosensitive drum 52, the transfer roller 58, and the paper P) based on the voltage value V2 outputted from the second voltmeter 112 and the current value I2 outputted from the second ammeter 111, and outputs the calculated resistance R to the transfer bias determining unit 150.

The transfer bias determining unit 150 determines the optimal transfer bias based on the humidity condition determined by the humidity determining unit 130 and the resistance R calculated by the resistance calculating unit 140.

Specifically, the transfer bias determining unit 150 determines an ambience category including possible ambient conditions corresponding to the resistance R by referencing the second data table (FIG. 7) and stores the determined ambience category in the storing unit 170.

Then, the transfer bias determining unit 150 determines an optimal transfer bias IT based on the humidity condition determined by the humidity determining unit 130 and the determined ambience category by referencing the third data table (FIG. 8) and outputs the determined optimal transfer bias IT to the transfer bias outputting unit 160.

The transfer bias applying unit 160 is a conventional instrument that applies a voltage to the transfer roller 58 for generating a current I2 in circuit B that approaches the optimal transfer bias IT. For example, the transfer bias applying unit 160 applies a smaller voltage if the current I2 becomes larger than the optimal transfer current IT by more than a predetermined value. On the other hand, the transfer bias applying unit 160 applies a larger voltage if the current I2 becomes smaller than the optimal transfer current IT by more than a predetermined value. Note that the transfer bias applying unit 160 may use PWM control to change the duty based on the difference between the optimal current IT and the current I2.

[Determination of Ambient Conditions]

Next, the method of determining the ambient conditions will be described while referring to FIGS. 1 and 4-8.

Figure 4:
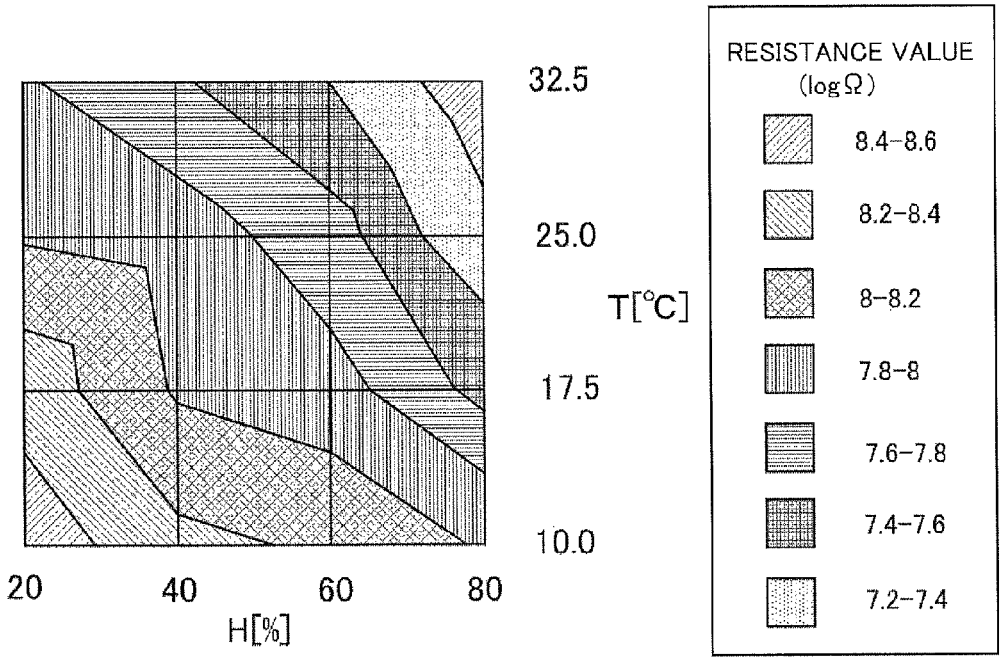
FIG. 4 is a diagram showing variations in the resistance value of the transfer roller in response to variations in temperature and humidity.

In the preferred embodiment, the transfer roller 58 has a metallic roller shaft 58*a* covered by an electrically conductive rubber material, such as acrylonitrile-butadiene rubber (NBR), which primarily conducts electricity via free ions acting as charge carriers (i.e., an ion-conductive material). The electrical properties of ion-conductive materials are more greatly influenced by moisture in the atmosphere (relative humidity) than the properties of electron-conductive materials. Therefore, the resistance of the transfer roller 58 changes greatly in response to changes in both ambient temperature and humidity (relative humidity). Further, the photosensitive drum 52 has a photosensitive layer formed of an organic photoconductor (OPC) layer. The electrical properties of the OPC are not greatly influenced by ambient conditions For example, as shown in FIG. 4, the resistance value of the transfer system (the photosensitive drum 52, the transfer roller 58, and the paper P sandwiched between the photosensitive drum 52 and the transfer roller 58) when the relative humidity is 20% and the temperature is 25° C. is almost the same as the resistance value of the transfer system when the relative humidity is 80% and the temperature is 10° C. Therefore, it is difficult to determine the ambient conditions based solely on resistance of the transfer system.

Figure 5:
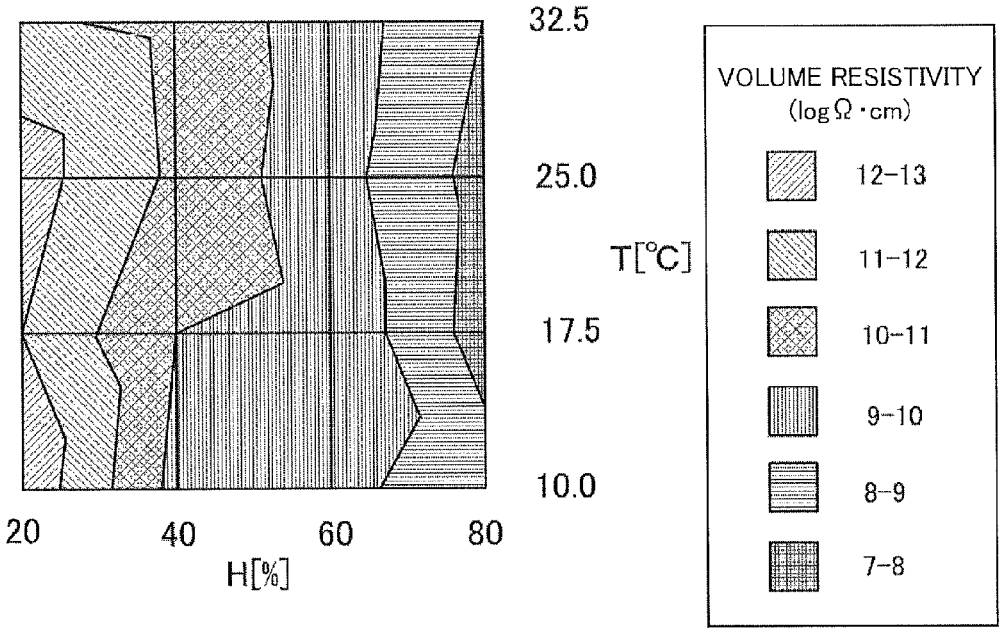
FIG. 5 is a diagram showing variations in the volume resistivity of the registration roller in response to variations in temperature and humidity.

On the other hand, each of the registration rollers 12 has a metallic roller shaft 12*a* covered by an electrically conductive rubber material, such as an ethylene-propylene-diene rubber (EPDM), which primarily conducts electricity using electrons as charge carriers (i.e., an electron-conductive material). Since the electrical properties of electron-conductive materials are not greatly influenced by ambient conditions, the resistance of the registration rollers 12 varies less in response to changes in the ambient temperature and humidity. Further, the electrical properties of the paper P have little dependence on ambient temperature but a high dependence on humidity. Therefore, as shown in the example of FIG. 5, the volume resistivity of the registration system (the pair of registration rollers 12 and the paper P sandwiched between the registration rollers 12) when the relative humidity is 60% changes very little when the temperature changes. In other words, the electrical properties of the registration system depend solely on moisture in the paper P (the humidity condition).

Therefore, the laser printer 1 according to the preferred embodiment firstly determines the humidity condition based on the electrical properties of the registration roller system, secondly determines the ambience category (possible ambient conditions) based on the resistance of the transfer system, and thirdly determines a suitable transfer bias based on the determined humidity condition and ambience category.

Here, the method of determining the humidity condition will be described while referring to FIG. 6.

In the preferred embodiment, a potential difference ΔV between the voltage value V1 when the paper P is sandwiched between the pair of registration rollers 12 and the voltage value V1 when the paper P is not sandwiched between the pair of registration rollers 12 is used to determine the humidity condition.

Specifically, as shown in FIG. 6, the first data table stores a humidity condition corresponding to each of specific ranges of potential differences ΔV. In the preferred embodiment, the humidity condition is categorized as "high" if the potential difference ΔV is found to be less than 0.05 kV when a bias that causes the ammeter 101 to detect a constant current of 10 μA is applied between the pair of registration rollers 12, and "low" if the potential difference ΔV is found to be more than 0.05 kV when the above bias is applied between the pair of registration rollers 12. Note that the current generated when a constant voltage is applied between the pair of registration rollers 12 may be used instead of the potential difference ΔV to determine the humidity condition.

In the preferred embodiment, the humidity condition is categorized as either "high" or "low." However, the humidity condition may be categorized as one of three or more categories instead.

Next, the method of determining the ambience category will be described while referring to FIG. 7.

As shown in FIG. 7, the second data table stores ambience categories a-d, each of which includes possible ambient conditions corresponding to each of various ranges of resistances R of the transfer system (the photosensitive drum 52, the transfer roller 58, and the paper P between the photosensitive drum 52 and the transfer roller 58). In FIG. 7, an "H" to the left of the "I" denotes a high temperature, an "L" to the left of the "/" denotes a low temperature, an "N" to the left of the "/" denotes a medium temperature, an "H" to the right of the "/" denotes a high humidity, and an "L" to the right of the "/" denotes a low humidity.

In FIG. 7, when the resistance R is below 100 MΩ, the ambience category is determined to be "a (H/H or H/L)"; when the resistance R is more than 100M Ω but below 200 MΩ, the ambience category is determined to be "b (H/L, L/H, or N/L)"; when the resistance R is more than 200 MΩ but below 300 MΩ, the ambience category is determined to be "c"; and when the resistance R is more than 300 MΩ, the ambience category is determined to be "d (L/L)." Note that the resistance of the transfer system when the paper P is not sandwiched between the photosensitive drum 52 and the transfer roller 58 may be used as the resistance R instead.

Next, the method of determining the transfer bias will be described while referring to FIG. 8.

As shown in FIG. 8, the third data table stores optimal currents IT for both the humidity condition determined in FIG. 6 and the ambience category determined in FIG. 7. For example, if the humidity condition is "high" and the category is "a," the optimal current IT is determined to be −8 μA.

[Control of Transfer Bias]

Figure 9:
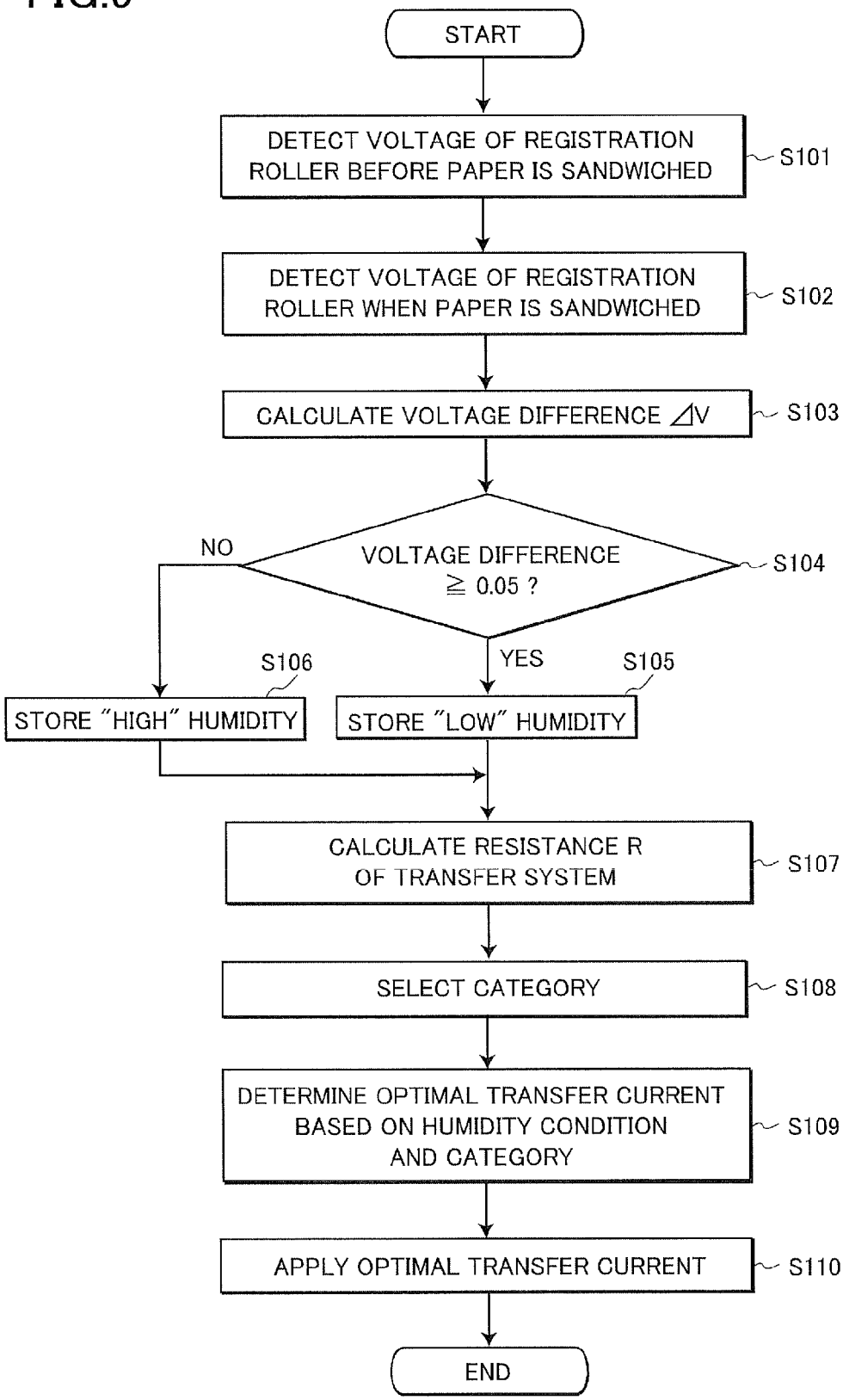
FIG. 9 is a flowchart of a process to control the transfer bias.

Next, one example of a process to control the transfer bias will be described while referring to FIG. 9. When the laser printer 1 receives a printing job, the controller 100 initiates the process in FIG. 9 to control the transfer current. First, the controller 100 detects the voltage V1 before the paper P is conveyed between the pair of registration rollers 12 (S101). Specifically, the controller 100 controls the power source 121 to apply a constant current of 10 μA to the pair of registration rollers 12, the feeding tray 31 to start conveying the paper P, and the first voltmeter 102 to detect the voltage V1 after the feeding tray 31 begins conveying the paper P and before the leading edge of the paper P has reached a nipping position at which the paper P is sandwiched between the pair of registration rollers 12. The timing at which the leading edge of the paper P has reached the nipping position can be calculated based on both the conveying speed and the conveying distance between the feeding tray 31 and the pair of registration rollers 31.

Next, the controller 100 detects the voltage V1 when the paper P is sandwiched between the pair of registration rollers 12 (S102). Specifically, the controller 100 controls the first voltmeter 102 to detect the voltage V1 after the leading edge of the paper P has passed the nipping position and before the trailing edge of the paper has passed the nipping position.

Next, the controller 100 calculates the voltage difference ΔV between the voltage V1 detected in S101 and the voltage V1 detected in S102 (S103) and determines the humidity condition based on the calculated voltage difference ΔV by referencing the first data table (FIG. 6; S104).

Specifically, as shown in FIG. 6, if the voltage difference ΔV is more than 0.05 kV (S104: YES), the controller 100 stores "low" in the storing unit 170 as the humidity condition (S105). On the other hand, if the voltage difference ΔV is under 0.05 kV (S104: NO), the controller 100 stores "high" in the storing unit 170 as the humidity condition (S106). For example, the controller 100 according to the preferred embodiment uses the conventional method of storing a flag in the storing unit 170 to indicate the humidity condition. In the following description, it will be assumed that the humidity condition has been determined to be "low" humidity.

Next, the controller 100 calculates the resistance R of the transfer system (S107). Specifically, the controller 100 controls the power source 122 to supply a bias between the photosensitive drum 52 and the transfer roller 58 at a timing when the leading edge of the paper P has reached the transfer position at which the paper P is sandwiched between the photosensitive drum 52 and the transfer roller 58, the second voltmeter 112 to detect the voltage V2, and the second ammeter 111 to detect the current I2 at that time. The controller 100 calculates the resistance R of the transfer system based on the detected voltage V2 and current I2.

Next, the controller 100 determines an ambience category based on the resistance R calculated in S107 by referencing the second data table (FIG. 7; S108) and stores the determined ambience category in the storing unit 170. Specifically, the ambience category indicating ambient conditions corresponding to the resistance R calculated in S112 is selected from among the categories a-d. For example, if the resistance R is 150 MΩ, the category "b" is selected. In the following description, it will be assumed that category "b" is selected.

Note that the second data table may store data adjusted for resistances R when the paper P is not sandwiched between the photosensitive drum 52 and the transfer roller 58. In such a case, in S107 the voltage V2 and the current I2 detected before the leading edge of the paper P has reached the transfer position between the photosensitive drum 52 and the transfer roller 58 is used to calculate the resistance R.

Next, the controller 100 determines an optimal transfer bias based on both the humidity condition determined in S104 and the ambience category determined in S108 by referencing the third data table (FIG. 8; S109). Since the humidity condition is "low" and the category is "b" in this example, the optimal bias current IT is determined to be −20 μA.

Finally, the controller 100 controls the power source 122 to apply the determined optimal transfer bias current IT to the transfer roller 58 (S110), and terminates the process.

[Effect of Controlling Transfer Bias]

As described above, the electrical dependence of the registration rollers 12 formed of an electron-conductive material on ambient variations is different from that of the transfer roller 58 formed of an ion-conductive material. The controller 100 determines the ambient conditions based on both the electrical properties of the registration system and the resistance of the transfer system. Therefore, it is possible to determine an optimal transfer bias for the actual ambient conditions. As the result, it is possible to foam a clear image on the paper P.

Further, data related to the dependence of the electrical properties of the transfer system and the registration roller system on ambient conditions is obtained in advance through experimentation. Therefore, it is possible to easily determine an optimal transfer bias by referring to the table storing the above data.

Second Embodiment

Next, the laser printer 1 according to a second embodiment of the present invention will be described while referring to FIGS. 10-13 wherein like parts and components to those in the first embodiment are designated by the same reference numerals to avoid duplicating description.

In the second embodiment, the resistance of the supply roller 55 having a metallic shaft covered by an ion-conductive material identical to that of the transfer roller 58 is used to determine the humidity condition instead of the resistance of the registration system. The environment dependence of electrical property of the supply roller 55 on ambient conditions is different from that of the transfer roller 58.

Figures 10, 11:
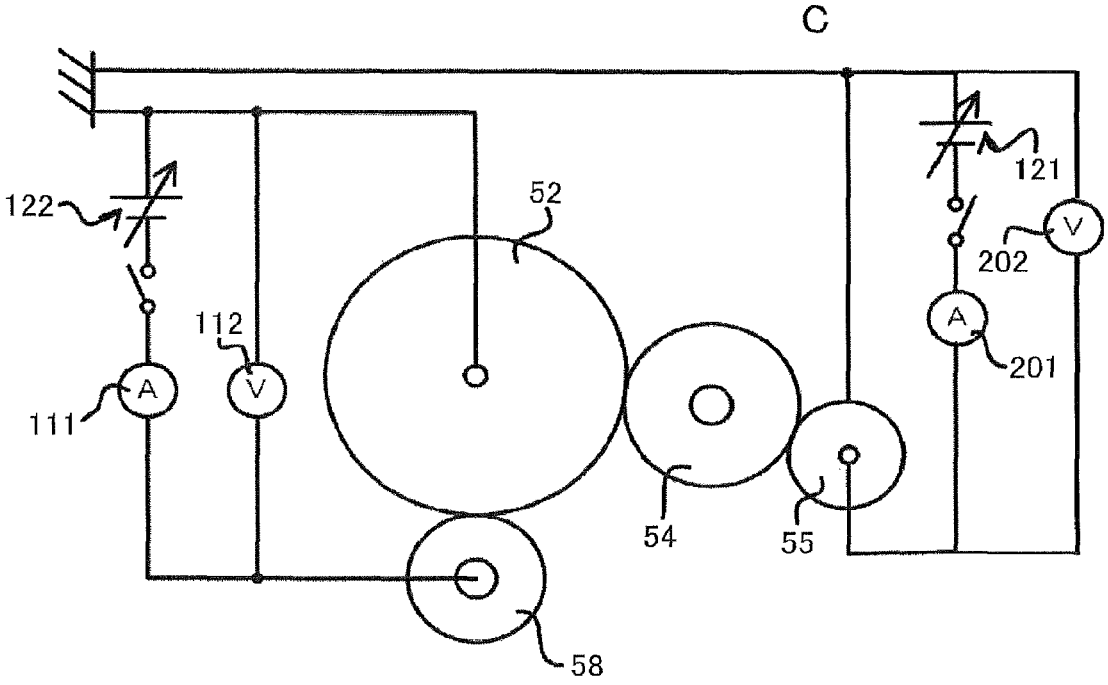
FIG. 10 is a circuit diagram for applying a bias to a transfer roller and a supply roller.
FIG. 11 is a fourth data table for determining a humidity condition.

As shown in FIG. 10, in a circuit C, the power source 121, the supply roller 55, and a third ammeter 201 are connected in series, and a third voltmeter 202 is connected in parallel with the supply roller 55. The third ammeter 201 detects a current value I3 of a current flowing in the circuit C, and the third voltmeter 202 detects a voltage value V3 of a voltage applied between the shaft of the supply roller 55 and the surface of the supply roller 55. The third ammeter 201 and the third voltmeter 202 output the respectively detected current value I3 and voltage value V3 to the resistance calculating unit 140, which also receives the current value I2 and the voltage value V2 from the second ammeter 111 and second voltmeter 112 as described above. The resistance calculating unit 140 calculates a resistance R2 of the transfer system based on the voltage value V2 and the current value I2, calculates a resistance R3 of the supply roller 55 based on the voltage value V3 and the current value I3, and outputs the calculated resistances R2 and R3 to the humidity determining unit 130.

The humidity determining unit 130 determines the humidity condition based on the resistances R2 and R3 by referencing a fourth data table (FIG. 11) and fifth data table (not shown) stored in the storing unit 170 for determining a humidity condition. The fourth data table stores temperatures and humidities corresponding to resistances R2 of the transfer system. The fifth data table stores temperatures and humidities corresponding to resistances R3 of the supply roller 55.

Figure 12:
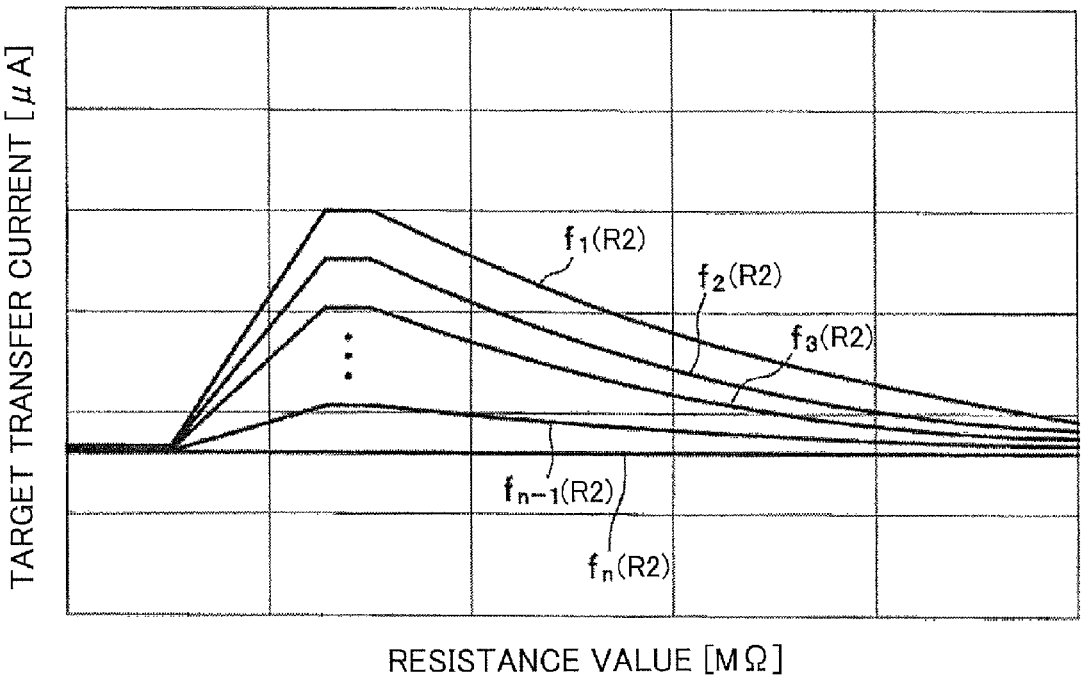
FIG. 12 is a graph showing a plurality of functions, each indicating an optimal transfer current for resistance of the transfer system.

As shown in FIG. 12, the storing unit 170 also stores a plurality of functions fn (R2), each indicating the optimal transfer bias (the target transfer current) for the resistance R2 of the transfer system. The plurality of functions fn (R2) respectively correspond to a plurality of humidity conditions. For example, the function f1 (R2) corresponds to 20% relative humidity, and the function f2 (R2) corresponds to 40% relative humidity. Alternatively, it is possible to simply use two different functions indicating the optimal transfer bias for a low humidity and a high humidity, respectively.

The transfer bias determining unit 150 reads the function fn (R2) corresponding to the humidity condition determined by the humidity determining unit 130 and determines an optimal transfer bias for the resistance R2 calculated by the resistance calculating unit 140 using the function fn (R2).

The transfer bias determining unit 150 outputs the determined optimal transfer bias IT to the transfer bias outputting unit 160. The transfer bias applying unit 160 applies a voltage to the transfer roller 58 for generating a current I2 in the circuit B that approaches the optimal transfer bias IT.

Figure 13:
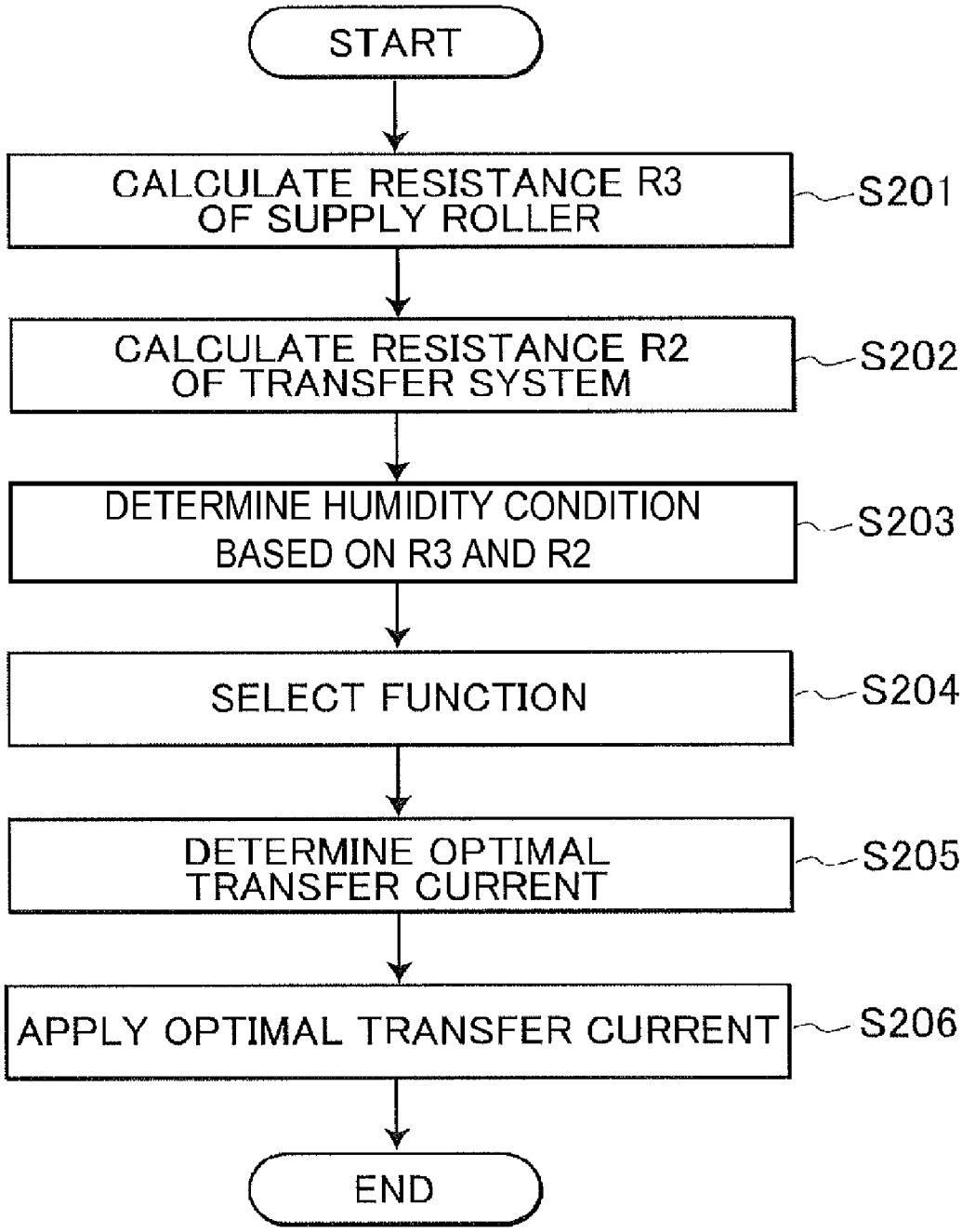
FIG. 13 is a flowchart of a process to control the transfer bias.

Next, the process to control the transfer bias according to the second embodiment will be described while referring to FIG. 13. When the laser printer 1 receives a printing job, the controller 100 initiates the process in FIG. 13 to control the transfer current. First, the controller 100 calculates the resistance R3 of the supply roller 55 (S201). Specifically, the controller 100 controls the power source 121 to apply a bias to the supply roller 55, the voltmeter 202 to detect the voltage V3, and the ammeter 201 to detect the current I3. The controller 100 calculates the resistance R3 based on the voltage V3 and the current I3.

Next, the controller 100 calculates the resistance R2 of the transfer system (S202). Specifically, the controller 100 controls the power source 122 to apply a bias to the transfer roller 58, the voltmeter 112 to detect the voltage V2, and the ammeter 111 to detect the current I2. The controller 100 calculates the resistance R2 based on the voltage V2 and the current I2. Then, the controller 100 determines the humidity condition based on the resistances R2 and R3 (S203).

Specifically, the controller 100 identifies a humidity condition common to both resistances R2 and R3 by referencing the fourth data table and the fifth data table for determining a humidity condition. For example, if the resistance R2 of the transfer system is 7.9 log Ω, then the controller 100 identifies the ambient conditions "humidity: 20%, temperature: 32.5° C.," "humidity: 20%, temperature: 25° C.," "humidity: 40%, temperature: 25° C.," "humidity: 40%, temperature: 17.5° C.," "humidity: 60%, temperature: 17.5° C.," "humidity: 80%, temperature: 10.0° C." in the fourth data table shown in FIG. 11 as the possible ambient conditions. In a similar manner, the controller 100 identifies possible ambient conditions for the resistance R3 of the supply roller 55 in the fifth data table.

The controller 100 determines that one ambient condition common to both the possible ambient conditions corresponding to the resistance R2 and the possible ambient conditions corresponding to the resistance R3 is the true ambient condition. If a plurality of ambient condition is common to both the possible ambient conditions corresponding to the resistance R2 and the possible ambient conditions corresponding to the resistance R3, the average of the plurality of ambient conditions can be determined as the true ambient condition, for example. In the following description, it will be assumed that the true ambient condition was found to be "humidity: 20%, temperature: 25° C."

The controller 100 selects one function fn (R2) corresponding to the determined ambient condition from among the plurality of functions fn (R2) (S204). In the following description, it will be assumed that the function f1 (R2) has been selected. Then, the controller 100 determines an optimal transfer current IT corresponding to the resistance R2 using the selected function fn (R2) (205).

Finally, the controller 100 controls the power source 122 to apply the determined optimal transfer current IT to the transfer roller 58 at a timing in which the paper P has reached the transfer point (S206), and terminates the process.

As described above, in the second embodiment, the fourth data table, the fifth data table, and the plurality of functions fn (R2) are stored in the storing unit 170. The controller 100 determines the humidity condition based on the resistance R2 of the transfer system and the resistance R3 of the supply roller 55, selects one function fn (R2) corresponding to the determined ambient conditions from among the plurality of functions fn (R2), and determines an optimal transfer bias corresponding to the resistance R2 using the selected function fn (R2). Thus, the controller 100 can easily determine the optimal transfer bias.

Further, since the function fn (R2) is used to determine the optimal transfer bias, the size of the data table, that is, the amount of data, stored in the storing unit 170 can be reduced.

Further, by using two rollers (e.g., the supply roller 55 and transfer roller 58) formed of the ion-conductive material but having different environmental dependence of electrical property, the controller 100 can identify one ambient condition common to different resistances possessed by the two rollers.

OTHER EMBODIMENTS

While the invention has been described in detail with reference to the embodiments thereof, it would be apparent to those skilled in the art that various changes and modifications may be made therein without departing from the spirit of the invention.

For example, the image-forming device may also determine a humidity condition based on the respective resistances R3 and R2 of the supply roller 55 and the transfer system, which are formed of an ion-conductive material, by referencing the fourth data table (FIG. 11) and the fifth data table, then determine the ambience category based on the resistance R2 by referencing the second data table (FIG. 7), and finally determine an optimal transfer bias can be determined based on the determined humidity condition and ambience category by referencing the third data table (FIG. 8).

In the first embodiment, the image-forming device detects the voltage V2 applied to the registration system after detecting the voltage V1 applied to the transfer system. However, the image-forming device may instead detect the voltage V1 after first detecting the voltage V2.

In the second embodiment, the image-forming device determines the humidity condition based on the resistance R3 of the supply roller 55 and the resistance R2 of the transfer system. However, the image-forming device may instead determine the humidity condition based on the resistance of the registration system in a manner similar to that described in the first embodiment, and may select a function fn (R2) corresponding to the humidity condition determined based on the resistance of the registration system.

In the second embodiment, the supply roller 55 is used as the ion-conductive material. However, another member, such as the developing roller, the fixing roller, or the conveying roller, can be used as the ion-conductive material instead. Further, this member may be formed of a type of conductive material that is not ion-conductive.

The image-forming device may determine an optimal transfer voltage, rather than an optimal transfer current, as the transfer bias. Further, at least one of the voltage and the current may serve as the electrical property instead of the resistance.

Further, a monochrome laser printer, a color printer, and an LED printer etc. can be adopted as the laser printer.

What is claimed is:

1. An image-forming device comprising:

an image-bearing member on which a developer image is formed with developer;

a transfer unit that transfers the developer image formed on the image-bearing member onto a sheet of paper at a transfer position located between the image-bearing member and the transfer unit;

a bias applying unit that applies a transfer bias to the transfer unit;

a pair of conveying rollers that conveys the sheet of paper to the transfer position;

a first sensor that detects an electrical property of the pair of conveying rollers;

a second sensor that detects an electrical property of the transfer unit;

a determining unit configured to determine an optimal bias for an ambient condition based on both of the detection results of the first sensor and the second sensor; and a controller configured to control the bias applying unit to apply the optimal bias to the bias applying unit.

2. The image-forming device according to claim 1, wherein the first sensor detects the electrical property of the pair of conveying rollers when the sheet of paper is sandwiched between the pair of conveying rollers.

3. The image-forming device according to claim 1, wherein the determining unit determines the ambient condition based on at least the detection result of the first sensor, and determines the optimal transfer bias based on both the determined ambient condition and the detection result of the second sensor.

4. The image-forming device according to claim 3, further comprising a storing unit that stores a first data table indicating the ambient condition corresponding to the detection result of the first sensor, and a second data table indicating the optimal bias corresponding to both of the ambient condition and the detection result of the second sensor, wherein the determining unit determines the ambient condition based on the detection result of the first sensor by referring to the first data table, and determines the optimal bias based on the detection result of the second sensor by referring to the second data table.

5. The image-forming device according to claim 3, further comprising a storing unit that stores a plurality of functions corresponding to a plurality of ambient conditions respectively, each function indicating the optimal transfer bias corresponding to the detection result of the second sensor, wherein the controller determines the ambient condition based on at least the detection result of the first sensor, selects one function from among the plurality of functions based on the determined ambient condition, and determines the optimal transfer bias by referring to the selected function.

6. An image-forming device comprising:

an image-bearing member on which a developer image is formed with developer;

a developing roller that carries the developer onto the image-bearing member;

a supply roller that supplies the developer to the developing roller;

a transfer unit that transfers the developer image formed on the image-bearing member onto a sheet of paper at a transfer position located between the image-bearing member and the transfer unit;

a bias applying unit that applies a transfer bias to the transfer unit;

a first sensor that detects an electrical property of the supply roller;

a second sensor that detects an electrical property of the transfer unit;

a determining unit configured to determine an optimal bias for an ambient condition based on both of the detection results of the first sensor and the second sensor; and a controller configured to control the bias applying unit to apply the optimal bias to the bias applying unit.

7. The image-forming device according to claim 6, wherein the determining unit determines the ambient condition based on at least the detection result of the first sensor, and determines the optimal transfer bias based on both the determined ambient condition and the detection result of the second sensor.

8. The image-forming device according to claim 7, further comprising a storing unit that stores a first data table indicating the ambient condition corresponding to the detection result of the first sensor, and a second data table indicating the optimal bias corresponding to both of the ambient condition and the detection result of the second sensor, wherein the determining unit determines the ambient condition based on the detection result of the first sensor by referring to the first data table, and determines the optimal bias based on the detection result of the second sensor by referring to the second data table.

9. The image-forming device according to claim 7, further comprising a storing unit that stores a plurality of functions corresponding to a plurality of ambient conditions respectively, each function indicating the optimal transfer bias corresponding to the detection result of the second sensor, wherein the controller determines the ambient condition based on both the detection results of the first sensor and the second sensor, selects one function from among the plurality of functions based on the determined ambient condition, and determines the optimal transfer bias by referring to the selected function.

10. The image-forming device according to claim 6, wherein each of the transfer unit and the supply rollers is formed of an ion-conductive material, an environmental dependence of electrical property of the transfer unit on the ambient condition being different from an environmental dependence of electrical property of the supply roller on the ambient condition.

11. An image-forming device comprising:

an image-bearing member on which a developer image is formed with developer;

a developing roller that carries the developer onto the image-bearing member;

a supply roller that supplies the developer to the developing roller;

a transfer unit that transfers the developer image formed on the image-bearing member onto a sheet of paper at a transfer position located between the image-bearing member and the transfer unit;

a first sensor that detects an electrical property of the supply roller;

a second sensor that detects an electrical property of the transfer unit;

a controller configured to:

apply a transfer bias to the transfer unit;

determine an optimal bias for an ambient condition based on both of the detection results of the first sensor and the second sensor; and control the bias to apply the optimal bias.

12. The image-forming device according to claim 11, wherein the controller is configured to determine the ambient condition based on at least the detection result of the first sensor, and determines the optimal transfer bias based on both the determined ambient condition and the detection result of the second sensor.

13. The image-forming device according to claim 12, wherein the controller is further configured to:

store a first data table indicating the ambient condition corresponding to the detection result of the first sensor, and a second data table indicating the optimal bias corresponding to both of the ambient condition and the detection result of the second sensor, determine the ambient condition based on the detection result of the first sensor by referring to the first data table, and determine the optimal bias based on the detection result of the second sensor by referring to the second data table.

14. The image-forming device according to claim 12, wherein the controller is further configured to:

store a plurality of functions corresponding to a plurality of ambient conditions respectively, each function indicating the optimal transfer bias corresponding to the detection result of the second sensor, determine the ambient condition based on both the detection results of the first sensor and the second sensor, select one function from among the plurality of functions based on the determined ambient condition, and determine the optimal transfer bias by referring to the selected function.

15. The image-forming device according to claim 11, wherein each of the transfer unit and the supply rollers is formed of an ion-conductive material, an environmental dependence of electrical property of the transfer unit on the ambient condition being different from an environmental dependence of electrical property of the supply roller on the ambient condition.

* * * * *